US007415234B2

(12) United States Patent
Kim et al.

(10) Patent No.: US 7,415,234 B2
(45) Date of Patent: Aug. 19, 2008

(54) IMAGE FIXING DEVICE OF AN IMAGE FORMING APPARATUS

(75) Inventors: Hwan-guem Kim, Seoul (KR); Joong-gi Kwon, Gunpo-si (KR); Durk-hyun Cho, Suwon-si (KR); Young-min Chae, Suwon-si (KR); Sang-yong Han, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 189 days.

(21) Appl. No.: 11/214,845

(22) Filed: Aug. 31, 2005

(65) Prior Publication Data

US 2006/0067749 A1 Mar. 30, 2006

(30) Foreign Application Priority Data

Sep. 11, 2004 (KR) ..... 10-2004-0072836

(51) Int. Cl.
*G03G 15/20* (2006.01)
*H05B 6/14* (2006.01)

(52) U.S. Cl. ..... 399/328; 219/619; 399/336

(58) Field of Classification Search ..... 219/619; 399/320, 328, 336

See application file for complete search history.

(56) References Cited

U.S. PATENT DOCUMENTS 7,113,736 B2 * 9/2006 Kikuchi et al. ..... 399/328
2002/0190060 A1 * 12/2002 Imai et al. ..... 219/619
2004/0253027 A1 * 12/2004 Kato et al. ..... 399/328

FOREIGN PATENT DOCUMENTS

| | | |
|---|---|---|
| CN | 1493939 | 5/2004 |
| JP | 10-254271 | 9/1998 |
| JP | 11-339940 | 12/1999 |
| JP | 2001-282025 | 10/2001 |
| JP | 2002-287563 | 10/2002 |

OTHER PUBLICATIONS

Chinese Office Action for corresponding Chinese Patent Application No. 2005101038416 dated Dec. 7, 2007.
Korean Patent Office Action for corresponding Korean Patent Application No. 10-2004-0072836 dated Mar. 23, 2006.

* cited by examiner

*Primary Examiner*—Hoang Ngo
(74) *Attorney, Agent, or Firm*—Staas & Halsey LLP

(57) ABSTRACT

A fixing device of an image forming apparatus includes a fixing roller rotatably mounted on a moving path of a printing medium having a toner image transferred thereon to fuse the toner image on the printing medium, a heater mounted in the fixing roller to generate a magnetic field by applied voltage, thus heating the fixing roller, and at least one magnetic core disposed around the fixing roller to concentrate, onto the fixing roller, the magnetic field generated by driving the heater. Accordingly, a density difference of the magnetic field generated by the heater is minimized by disposing the at least one magnetic core around the fixing rollers, thus enabling a uniform fixing temperature.

34 Claims, 9 Drawing Sheets

IMAGE FIXING DEVICE OF AN IMAGE FORMING APPARATUS

CROSS-REFERENCE TO RELATED APPLICATIONS

This application claims the benefit of Korean Patent Application No. 2004-72836, filed Sep. 11, 2004, in the Korean Intellectual Property Office, the disclosure of which is incorporated herein by reference.

BACKGROUND OF THE INVENTION

1. Field of the Invention

The present invention relates to an image forming apparatus. More particularly, the present invention relates to a fixing device for an image forming apparatus, for fusing a predetermined toner image transferred onto a printing medium by heat and pressure.

2. Description of the Related Art

General image forming apparatuses such as a copy machine, a printer, a facsimile and a multi-function machine which compositely comprises functions of the preceding apparatuses, print out an input image signal onto a printing medium.

Such an image forming apparatus comprises a developing unit, a transfer unit and a fixing unit. FIG. 1 shows an example of the fixing unit which fuses a transferred toner image onto the printing medium by the transfer unit using heat and pressure.

Referring to FIG. 1, the fixing unit includes first and second fixing rollers 10 and 20 operating in rolling contact with each other by a predetermined fixing nip.

The first fixing roller 10 includes therein a halogen lamp 11. The halogen lamp 11 heats the first fixing roller 10 up to a predetermined temperature (hereinafter, referred to as a "fixing temperature") for an image fixing operation and maintains the fixing temperature. As a result, the toner image transferred to the printing medium P is properly heated to be fused as passing through a space between the first and the second fixing rollers 10 and 20.

The second fixing roller 20 is biased toward the first fixing roller 10 by an elastic member 21 to fuse the toner image on the printing medium P which is heated by the first fixing roller 10.

However, the general fixing unit of an image forming apparatus, as described above, is structured in a manner that the heat generated by the halogen lamp 11 disposed at the center portion inside the first fixing roller 10 is radiantly transmitted to the first fixing roller 10, thus heating the first fixing roller 10 throughout. Therefore, the first fixing roller 10 may be unnecessarily heated even at a portion thereof which would not contact the printing medium P, accordingly causing loss of heat. Furthermore, since the first fixing roller 10 is preheated without contacting the halogen lamp 11, an extended time is taken for the first fixing roller 10 to reach the fixing temperature. In other words, a warming-up time of the first fixing roller 10 is elongated.

The warming-up time may be reduced by heating the first fixing roller 10 by an induction heat from a magnetic field generated at an induction coil upon application of voltage and a resistance heat from a resistant load of the induction coil itself. To overcome the problem, research for reducing the warming-up time noted above is in active progress.

However, when heating the first fixing roller 10 using the induction coil, the magnetic field generated at the induction coil is concentrated at the opposite ends of the first fixing roller 10. Such a density difference between a middle portion and the end portions of the first fixing roller 10 results in unevenness of the fixing temperature.

SUMMARY OF THE INVENTION

Aspects of the present invention include solving at least the above problems and/or disadvantages and providing at least the advantages described below. Accordingly, an aspect of the present invention is providing an improved fixing device of an image forming apparatus that is capable of leveling a fixing temperature.

To achieve the above-described aspects of the present invention, a fixing device comprises a fixing roller rotatably mounted on a moving path of a printing medium having a toner image transferred thereon to fuse the toner image on the printing medium, a heater mounted in the fixing roller to generate a magnetic field by applied voltage, thus heating the fixing roller, and at least one magnetic core disposed around the fixing roller to concentrate the magnetic field generated by driving the heater to the fixing roller.

The at least one magnetic core is separated from an outer circumferential surface of the fixing roller by a predetermined distance, wherein the magnetic core faces the fixing roller. The fixing device may further comprise a blocking member enclosing the at least one magnetic core and the fixing roller to block noise interference.

The at least one magnetic core is disposed in the fixing roller at a predetermined distance from an inner circumferential surface of the fixing roller.

The at least one magnetic core is disposed at the center of the fixing roller in a length direction of the fixing roller.

A pair of the magnetic cores is disposed with the cores being parallel to each other in the length direction of the fixing roller.

The at least one magnetic core comprises at least one first magnetic core disposed at a predetermined distance from an outer surface of the fixing roller; and at least one second magnetic core disposed in the fixing roller without contacting the fixing roller.

The at least one magnetic core may have a substantially circular section or a polygonal section.

The heater is mounted in secure contact with the inner circumferential surface of the fixing roller.

The fixing roller and the heater are rotated together.

The fixing device may further comprise an insulator between the fixing roller and the heater.

The heater comprises an induction coil to heat the fixing roller using an induction heat from a magnetic field generated by voltage application and a resistance heat from a resistant load of the induction coil itself. Here, the induction coil is made of at least one material selected from the group consisting of copper, aluminum, nickel, iron and chrome.

According to another aspect of the present invention, a fixing device of an image forming apparatus, comprises a first fixing roller rotatably mounted on a moving path of a printing medium which has a toner image transferred thereon; a second fixing roller rotating in contact with the first fixing roller to fuse the toner image onto the printing medium that passes through a space between the first and the second fixing rollers; a heater mounted in at least one of the first and the second fixing rollers to generate a magnetic field by voltage application, thus heating a corresponding heater; and at least one magnetic core disposed around the fixing roller being heated by the heater so that the magnetic field generated by the heater is concentrated on the heated fixing roller.

The at least one magnetic core is separated from an outer circumferential surface of the heated fixing roller by a predetermined distance, wherein the magnetic core faces the heated fixing roller. The fixing device may further comprise a blocking member enclosing the at least one magnetic core, and the first and the second fixing rollers to thus block noise interference.

The at least one magnetic core is disposed in the first fixing roller at a predetermined distance from an inner circumferential surface of the fixing roller.

The at least one magnetic core is disposed at the center of the fixing roller in a length direction of the fixing roller.

The at least one magnetic core comprises at least one first magnetic core disposed at a predetermined distance from an outer surface of at least one of the fixing rollers; and at least one second magnetic core disposed in at least one of the fixing rollers without contacting the fixing roller A pair of the at least one magnetic core is mounted in the heated fixing roller.

The at least one magnetic core is formed as a plate and is disposed near the entrance of the printing medium passing through a space between the first and the second fixing rollers.

The heater is mounted in secure contact with the inner circumferential surface of the fixing roller mounting the heater.

The heater is rotated together with the fixing roller used to mount the heater.

The fixing device may further comprise an insulator between the heater and the fixing roller mounted on the heater.

The first fixing roller serves as a heating roller mounting therein the heater, and the second fixing roller serves as a pressing roller to press the first fixing roller by a predetermined pressure.

The heater comprises an induction coil to heat the fixing roller using an induction heat from a magnetic field generated by voltage application and a resistance heat from a resistant load of the induction coil itself.

Here, the induction coil is made of at least one material selected from the group consisting of copper, aluminum, nickel, iron and chrome.

The at least one magnetic core may have a substantially circular section or a polygonal section.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
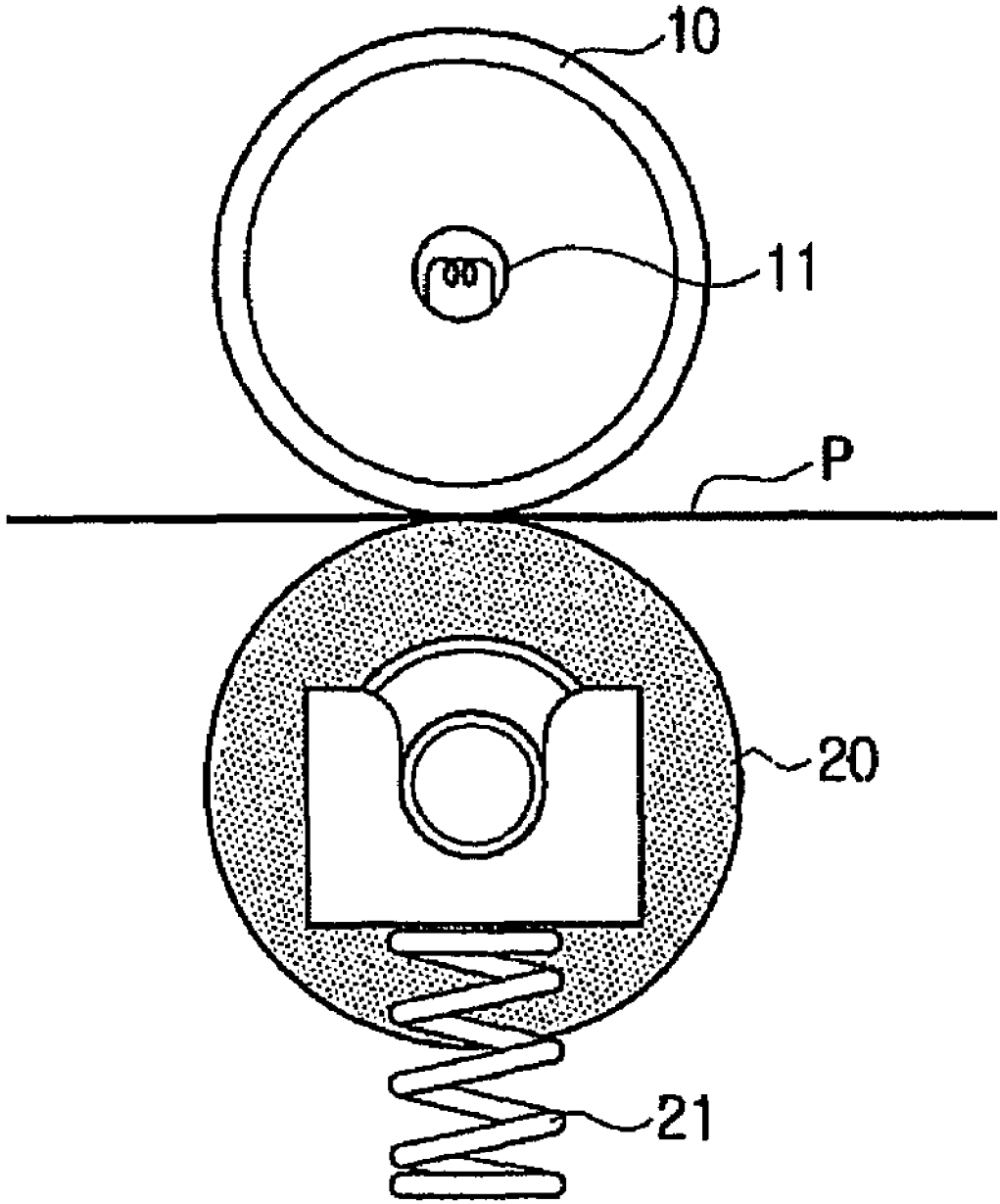
FIG. 1 (PRIOR ART)
FIG. 1 is a longitudinal-sectional view of a general fixing device in an image forming apparatus.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, an embodiment of the present invention will be described in detail with reference to the accompanying drawing figures.

In the following description, the same drawing reference numerals are used for the same elements even in different drawings. The matters defined in the description such as a detailed construction and elements are provided to assist in a comprehensive understanding of the invention. Thus, it is apparent that the present invention may be carried out without those defined matters. Also, well-known functions or constructions are not described in detail since they would obscure the invention in unnecessary detail.

Figure 2:
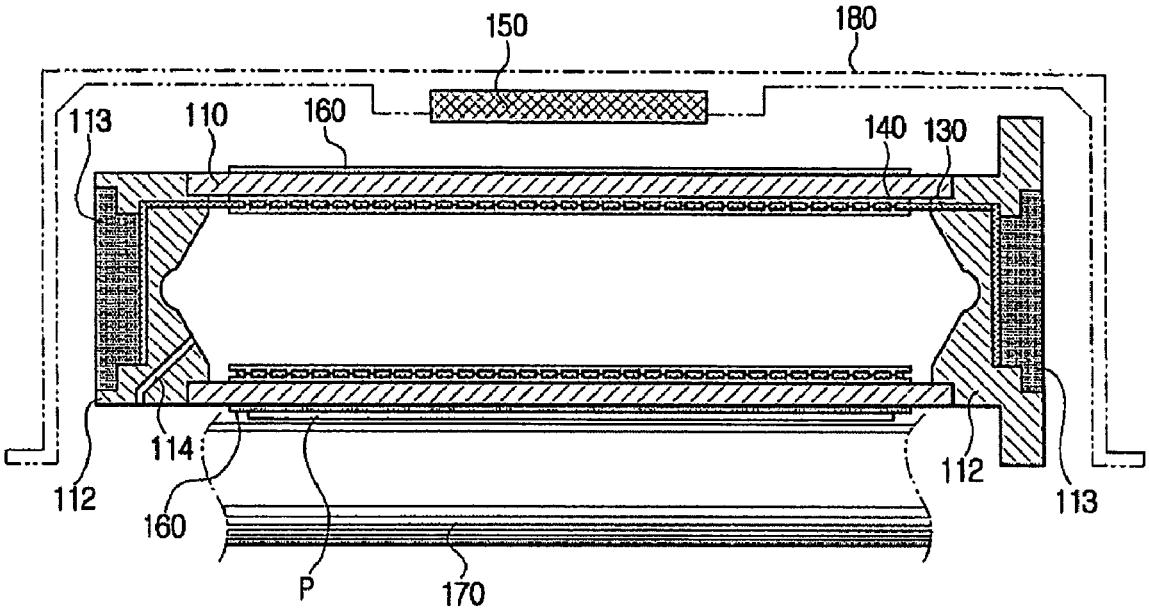
FIG. 2 is a cross-sectional view of a fixing device of an image forming apparatus according to a first embodiment of the present invention.

FIG. 2 is a cross-sectional view of a fixing device of an image forming apparatus according to a first embodiment of the present invention. Referring to FIG. 2, the fixing device of the image forming apparatus comprises a fixing roller 110, a heater 130, an insulator 140 and a magnetic core 150. Reference numeral 160 denotes a coating film made of a predetermined material on an outer circumferential surface 111 of the fixing roller 110. The coating film 160 may be made of heat-resistant material such as Teflon®.

The fixing roller 110 is rotatably disposed on a moving path of a printing medium P having an image transferred thereon.

The fixing roller 110 is formed of a material having high thermal conductivity. More specifically, the fixing roller 110 may be formed of one of copper, aluminum, iron and nickel, or an alloy containing at least two of the cited metals.

The fixing roller 110 has a tubular form of which opposite ends are connected with end caps 112. The end caps 112 are formed by injection molding of the insulator and provided with a terminal 113 on the outside thereof, which is electrically connected with a heater 130 to apply electric power to the heater 130. The end cap 112 further comprises an air vent 114 for preventing expansion of air pressure within the fixing roller 110.

The fixing roller 110 rotates in contact with another roller such as a pressing roller 170. The pressing roller 170 is biased by an elastic member (not shown) toward the fixing roller 110, such that the printing medium P is pressed while passing through a space between the fixing roller 110 and the pressing roller 170.

The heater 130 is attached to an inner circumferential surface of the fixing roller 110 by a high-temperature adhesive, thus rotating together with the fixing roller 110. Generally, the heater 130 comprises an induction coil driven by an alternating current (AC) applied from a high-frequency insulation transformer (not shown). The induction coil causes an induction heat from a magnetic field generated by the applied AC and a resistance heat from a resistant load of the induction coil itself.

The induction coil may be formed by at least one of copper, aluminum, iron and nickel, which are capable of generating the induction heat and the resistance heat. Further, the induction coil may be shaped in various forms, such as a square, a circle, an oval and a ribbon.

The insulator 140 encloses an outer surface of the heater 130 for isolation between the fixing roller 110 and the heater 130. Due to the insulator 140, loss of the magnetic field caused at the heater 130 may be reduced. The insulator 140 may be formed by coating the outer surface of the heater 130 with a material having excellent insulation characteristics, such as artificial mica.

The magnetic core 150 is disposed at a predetermined distance from the outer circumference of the fixing roller 110 parallel to the fixing roller 110 such that the magnetic field generated by the heater 130 is concentrated toward the fixing roller 110. In addition, the magnetic core 150 is disposed corresponding to the middle of the fixing roller 110 to compensate for the density difference of the magnetic field between the middle portion and end portions of the fixing roller 110.

By equipping the magnetic core 150 on the outside of the fixing roller 110, the density difference of the magnetic field generated along a length direction of the fixing roller 110 may be effectively decreased. Accordingly, minute control of the temperature of the fixing roller 110 may be implemented, thus improving printing quality.

Further, a blocking member 180 may be utilized to block noise caused among parts around the magnetic core 150 and the fixing roller 110, the blocking member 180 being formed to enclose the magnetic core 150 and the fixing roller 110.

The blocking member 180 is generally made of a steel plate. In this embodiment, a fixing device housing (not shown) is made of a steel plate rather than by injection molding of plastic so as to also function as the blocking member. Alternatively, the blocking member 180 may be supported in the housing formed by injection molding of plastic.

Figure 3A:
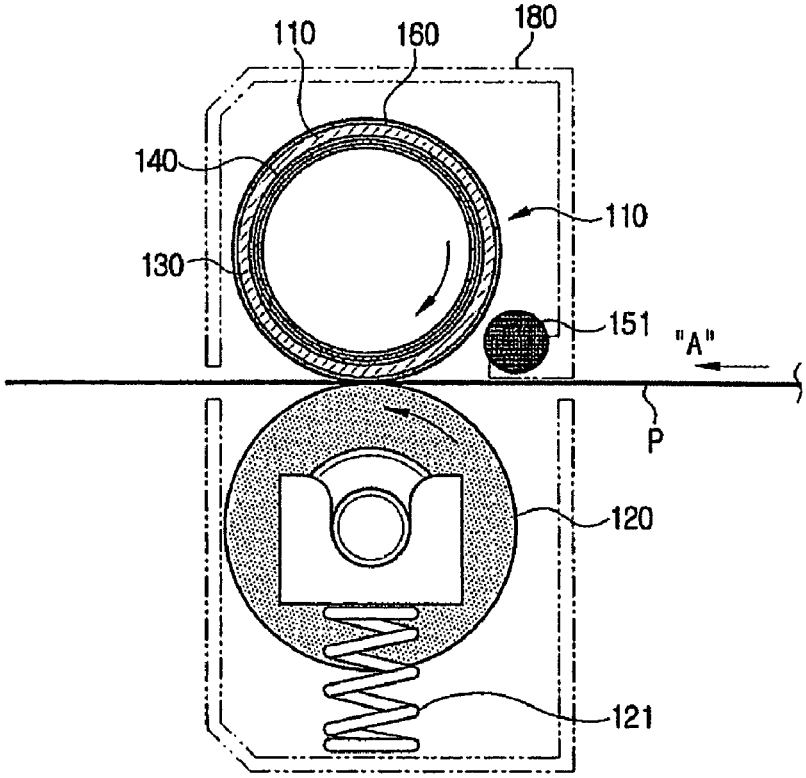
FIG. 3A is a longitudinal-sectional view of a fixing device of an image forming apparatus according to a second embodiment of the present invention.

Referring to FIG. 3A, a fixing device of an image forming apparatus according to a second embodiment of the present invention, comprises a first fixing roller 110', a second fixing roller 120 and a magnetic core 151. The first fixing roller 110' structured and operated in the same manner as the fixing roller 110 of FIG. 2 will not be described in detail hereinbelow. Detailed descriptions about the heater 130, the insulator 140, the coating film 160 and the blocking 180 that have been explained with reference to FIG. 2 will not be repeated in explaining the present embodiment and the other further embodiments.

The second fixing roller 120 is biased toward the first fixing roller 110' by an elastic member 121. The second fixing roller 120 may further serve as a heating roller having therein a heater 130, or may serve only as a pressing roller for pressing the first fixing roller 110'.

As shown in FIG. 3A, the magnetic core 151 is disposed at an entrance A for the printing medium P that passes through a space between the first and the second fixing rollers 110' and 120. The magnetic core 151 has a substantially circular section and is supported by the blocking member 180. By disposing the magnetic core 151 at the entrance A, the first fixing roller 110' may reach a temperature for the fixing operation (hereinbelow, referred to as the 'fixing temperature') before the printing medium P passes through a space between the first and the second fixing rollers 110' and 120. As a result, a warming-up time for preheating the fixing device may be shortened. In addition, the density difference of the magnetic field, especially at the entrance A may be reduced, thus regulating the fixing temperature at the entrance A.

Figure 3B:
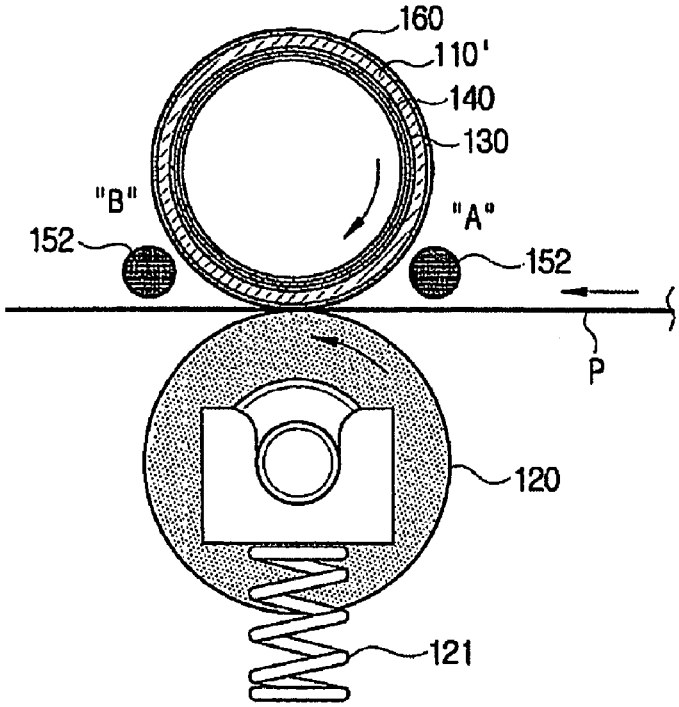
FIG. 3B is a longitudinal-sectional view of a fixing device of an image forming apparatus according to a third embodiment of the present invention.

Referring to FIG. 3B, the fixing device according to a third embodiment of the present invention comprises a pair of magnetic cores 152 symmetrically disposed with respect to the first fixing roller 110'. More specifically, the pair of magnetic cores 152 are disposed respectively at the entrance A and an exit B for the printing medium P that passes through a space between the first and the second fixing rollers 110' and 120. Accordingly, the fixing temperature at the entrance A and the exit B of the printing medium P may be regularly controlled.

Figure 3C:
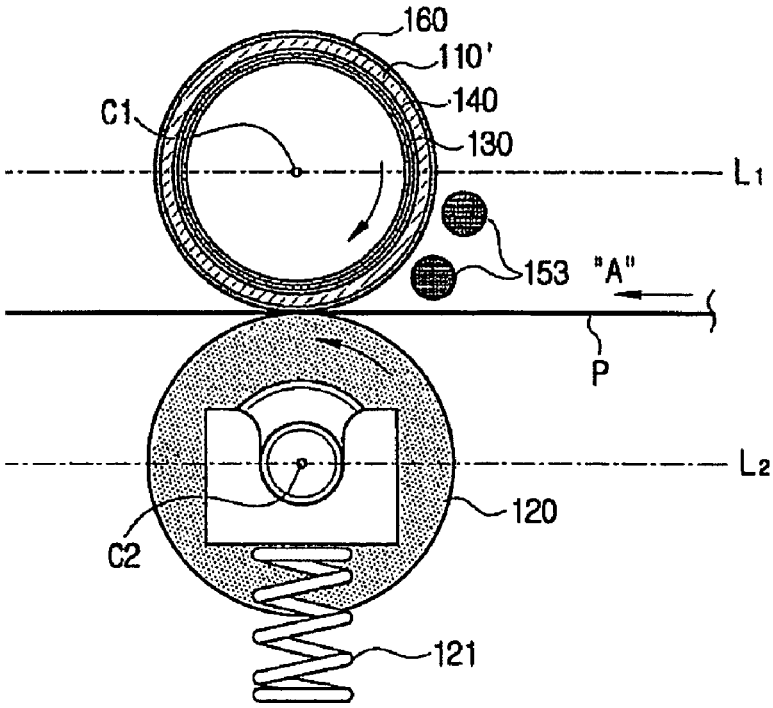
FIG. 3C is a longitudinal-sectional view of a fixing device of an image forming apparatus according to a fourth embodiment of the present invention.

Referring to FIG. 3C showing a fourth embodiment of the present invention, a pair of magnetic cores 153 are all disposed near the entrance A of the printing medium P. The pair of connect cores 153 are disposed adjacent to the first fixing roller 110' side by side. By existence of the pair of magnetic cores 153 provided at the entrance A, the warming-up time for the first fixing roller 110' at the entrance A may be reduced, and also, the temperature of the first fixing roller 110' may be made uniform in the length direction.

Assuming that first and second lines L1 and L2 denote imaginary lines passing a first fixing roller center C1 and a second fixing roller center C2, respectively, parallel to a moving direction of the printing medium P that passes through a space between the first and the second fixing rollers 110' and 120, it is typical that the magnetic cores 153 are located between the first and the second lines L1 and L2. Such a location of the magnetic cores 153 may be applied in all the other embodiments of the present invention. By disposing the magnetic cores 153 between the first and the second lines L1 and L2, the density difference of the magnetic field may be efficiently compensated, especially near the printing medium P, of the outer circumferential surface of the first and the second fixing rollers 110' and 120. Accordingly, the fixing temperature may be made uniform in a direction perpendicular to the moving direction of the printing medium P.

Figure 4A:
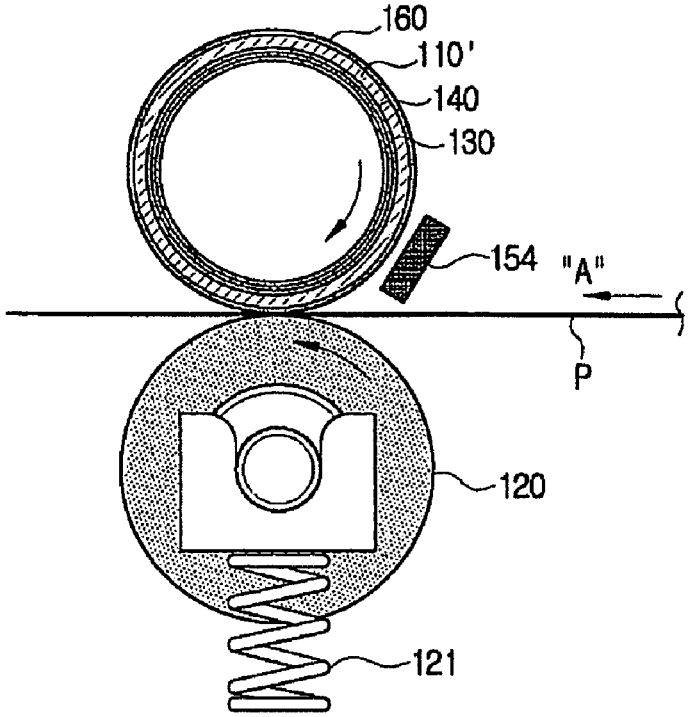
FIG. 4A is a longitudinal-sectional view of a fixing device of an image forming apparatus according to a fifth embodiment of the present invention.
Figure 4B:
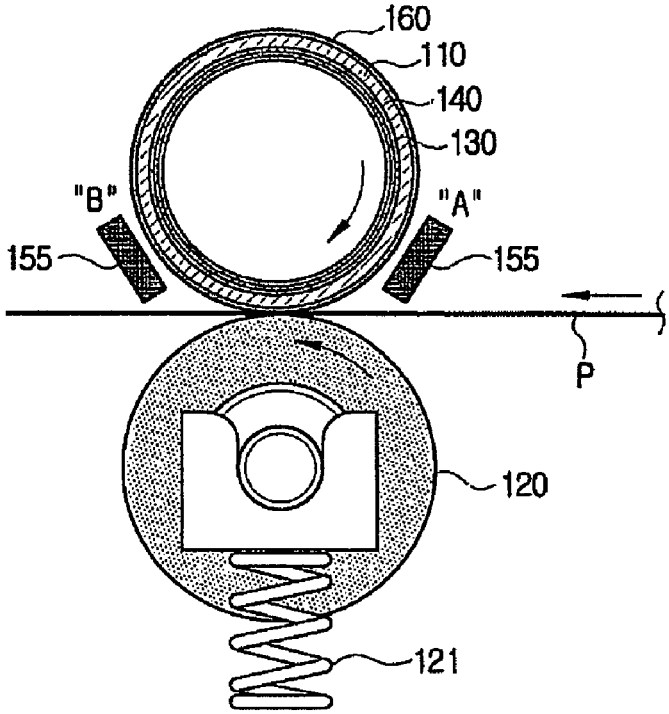
FIG. 4B is a longitudinal-sectional view of a fixing device of an image forming apparatus according to a sixth embodiment of the present invention.
Figure 4C:
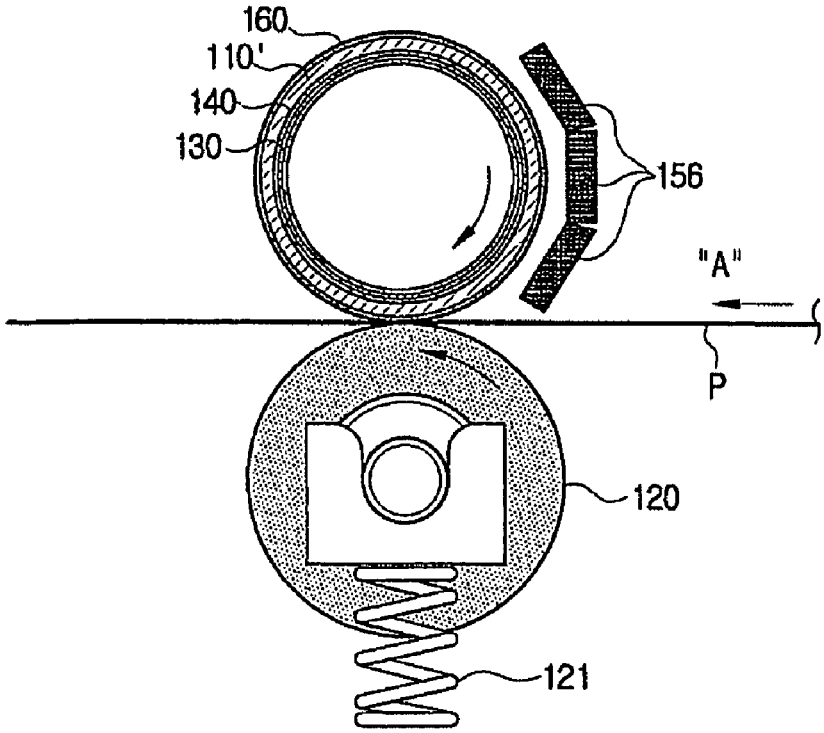
FIG. 4C is a longitudinal-sectional view of a fixing device of an image forming apparatus according to a seventh embodiment of the present invention.

As shown in FIGS. 4A through 4C, one or more magnetic cores 154, 155 and 156 having a substantially square section may be provided.

Referring to FIG. 4A, a fixing device according to a fifth embodiment of the present invention comprises a connect core 154 having a square section at the entrance A. The magnetic core 154 offers the same function and effects as the magnetic core 151 of FIG. 3A.

According to a sixth embodiment of the present invention, as shown in FIG. 4B, a fixing device comprises a pair of magnetic cores 155 having a square section and located at the entrance A and the exit B of the printing medium P, respectively.

According to a seventh embodiment of the present invention, as shown in FIG. 4C, a fixing device comprises three magnetic cores 156 all located near the entrance A. The three magnetic cores 156 having a square section are arranged to adjoin one another. The magnetic cores 156 enclose a part of the first fixing roller 110'.

Figure 5A:
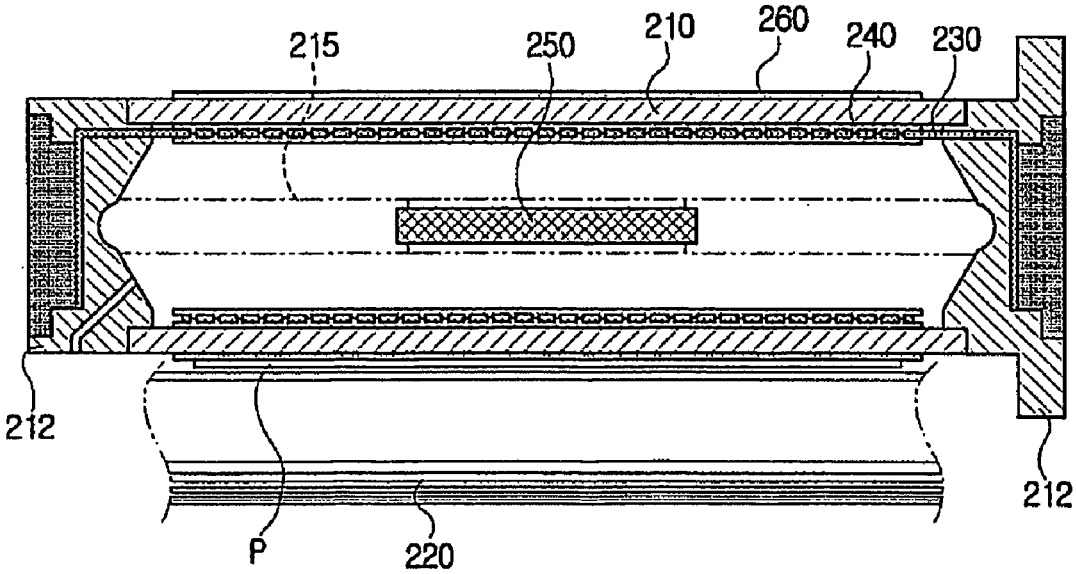
FIGS. 5A and 5B are a cross-sectional view and a longitudinal-sectional view, respectively, of a fixing device of an image forming apparatus according to an eighth embodiment of the present invention.
Figure 5B:
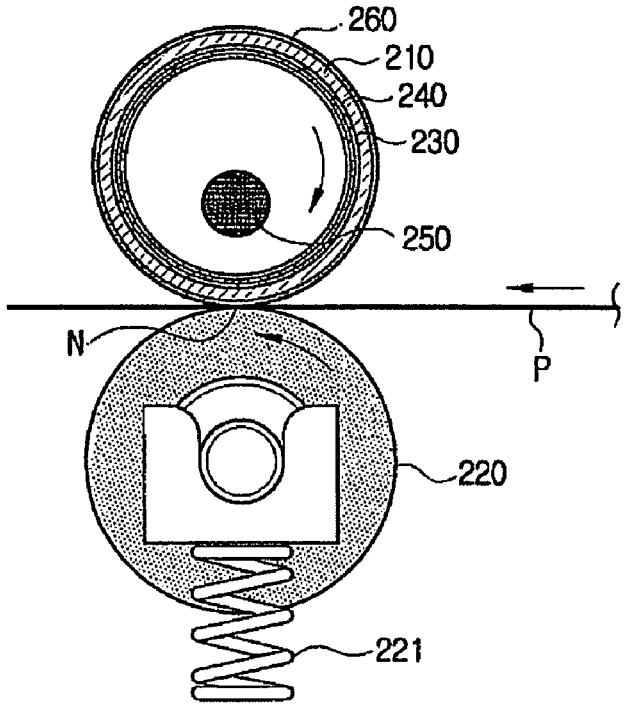

FIGS. 5A and 5B show a fixing device according to an eighth embodiment of the present invention that has a magnetic core 250 mounted inside a first fixing roller 210. The fixing device comprises the first fixing roller 210, a second fixing roller 220, a heater 230, an insulator 240 and a coating film 260. The structure and the operation of the heater 230, the insulator 240 and the coating film 260 are the same as those of FIG. 2. Therefore, only distinctive features of the present embodiment will be explained, while the other known elements will not be described concisely.

Although the magnetic core 250 and the magnetic core 150 of FIG. 2 are similarly structured with respect to each other, unlike the magnetic core 150, the magnetic core 250 is disposed inside the first fixing roller 210, as shown in FIGS. 5A and 5B.

More specifically, the magnetic core 250 is disposed inside the first fixing roller 210 and is separated from an inner circumferential surface of the first fixing roller 210 by a predetermined distance. Additionally, the magnetic core 250 has a substantially circular section. Therefore, the magnetic core 250 is supported by a supporting member 215 connected to end caps 212, thus being mounted in the first fixing roller 210 without contacting the fixing roller.

The magnetic core 250 is inclined toward a fixing nip N, which is a contact between the first and the second fixing rollers 210 and 220. This is to shorten the warming-up time by locating the magnetic core 250 closer to the moving path of the printing medium P.

In the case wherein the magnetic core 250 is disposed inside the first fixing roller 210, the blocking member 180 of FIG. 2 is not required because the first fixing roller 210 may serve as the blocking member 180.

Accordingly, by disposing the magnetic core 250 in the first fixing roller 210, the density difference of the magnetic field generated at the first fixing roller 210 may be reduced without requiring expansion of the volume of the fixing device.

Figure 6A:
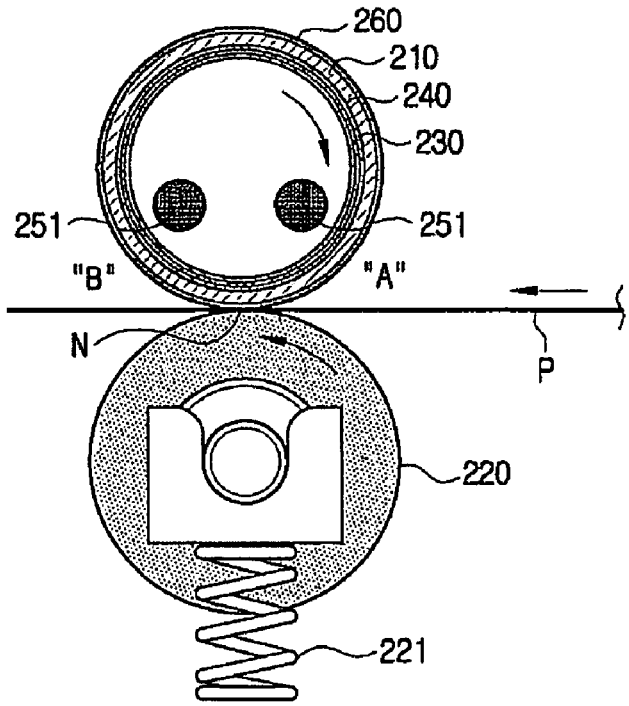
FIG. 6A is a longitudinal-sectional view of a fixing device of an image forming apparatus according to a ninth embodiment of the present invention.
Figure 6B:
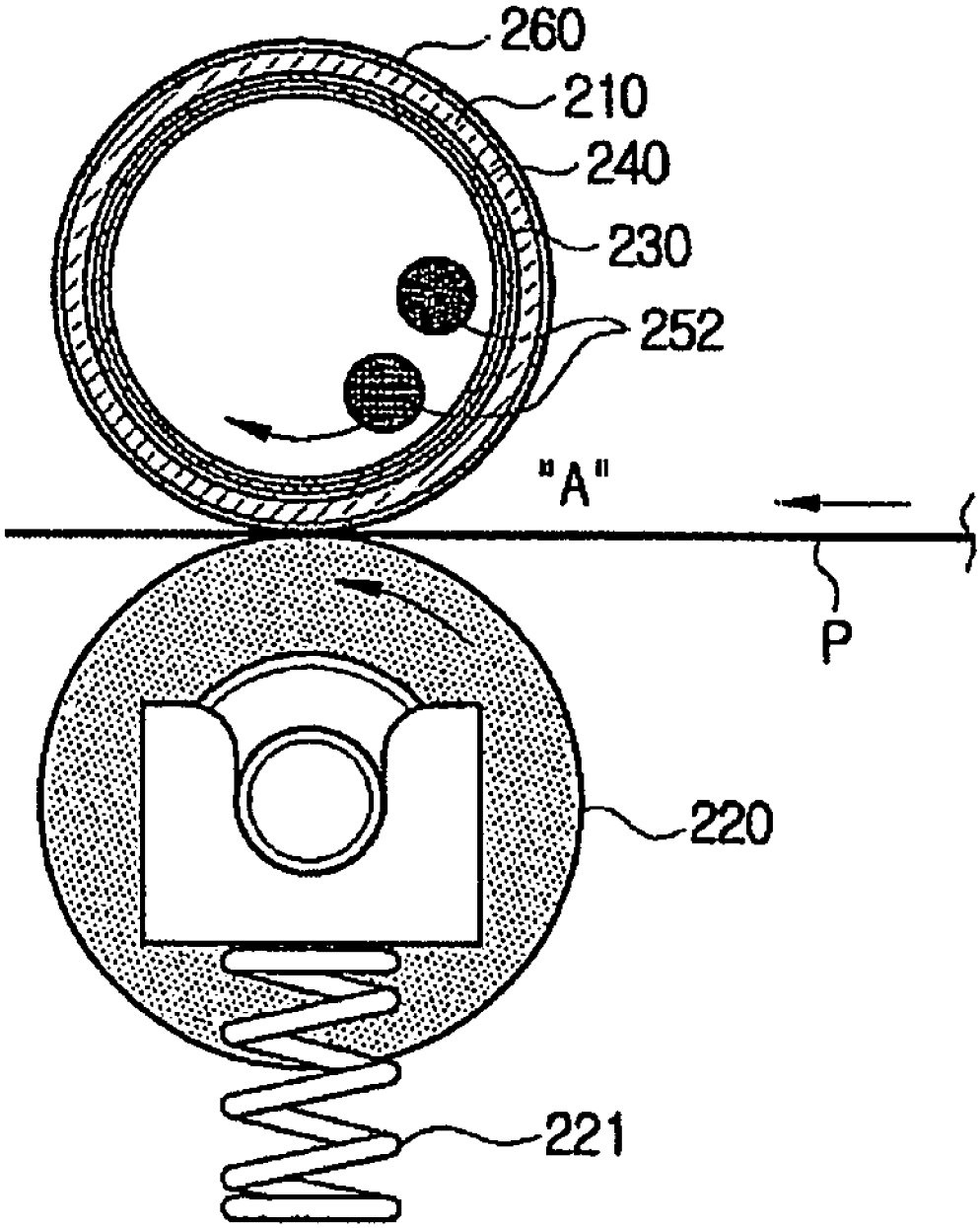
FIG. 6B is a longitudinal-sectional view of a fixing device of an image forming apparatus according to a tenth embodiment of the present invention.

Otherwise, a pair of magnetic cores 251 and 252 may be disposed at certain locations inside the first fixing roller 210, as shown in FIGS. 6A and 6B, according to the ninth and tenth embodiments of the present invention.

The magnetic cores 251, according to the ninth embodiment, are inclined toward the entrance A and the exit B of the printing medium P, respectively, to uniformly supply the fixing temperature at the moving path of the printing medium P.

Figure 7A:
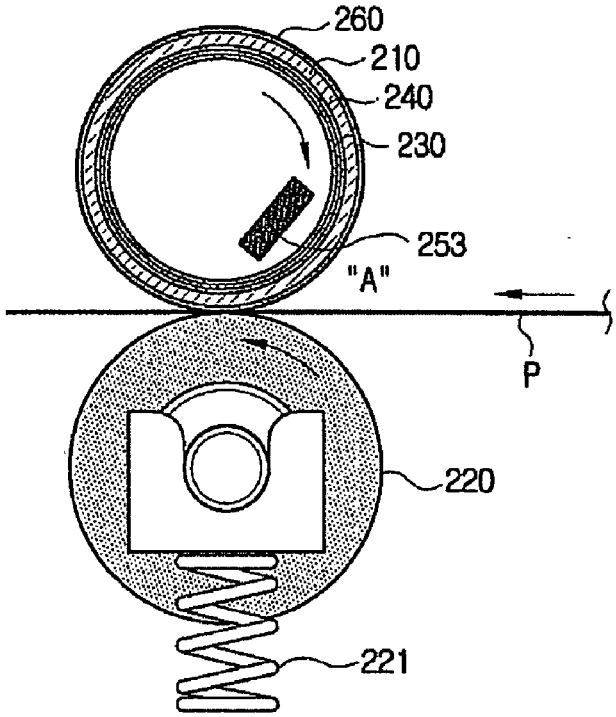
FIG. 7A is a longitudinal-sectional view of a fixing device of an image forming apparatus according to an eleventh embodiment of the present invention.
Figure 7B:
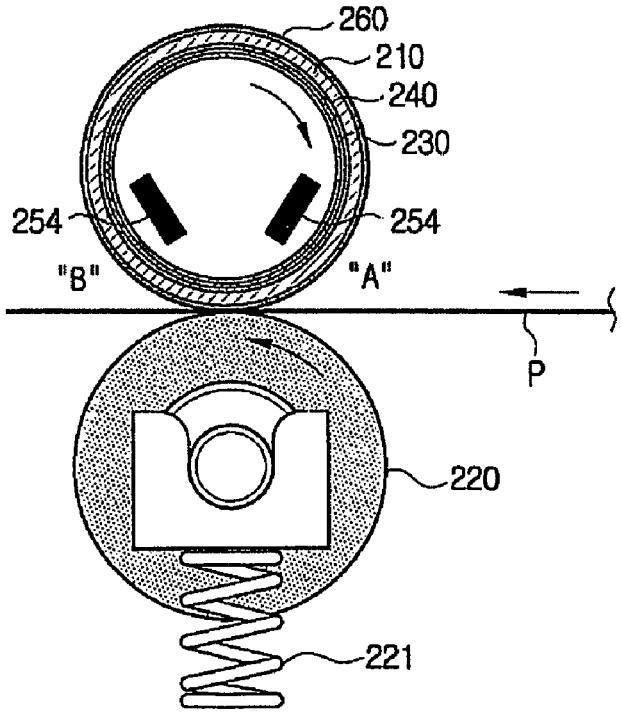
FIG. 7B is a longitudinal-sectional view of a fixing device of an image forming apparatus according to a twelfth embodiment of the present invention.
Figure 7C:
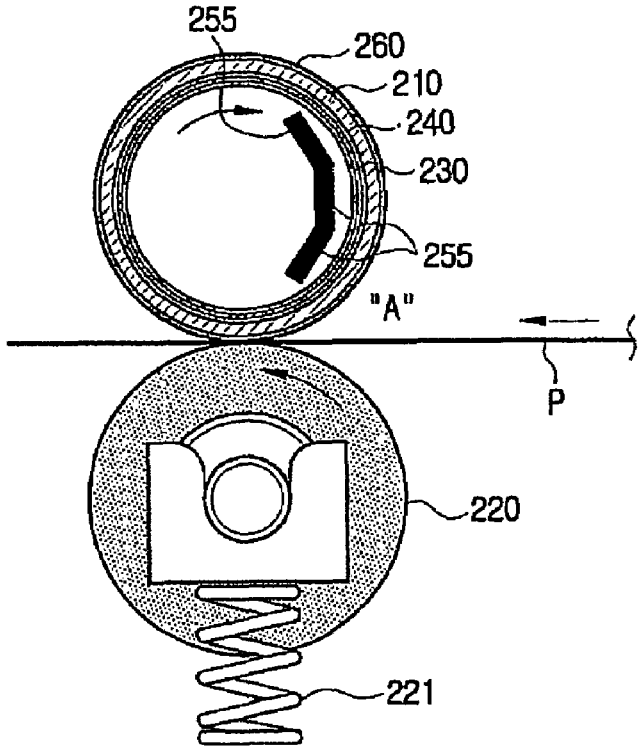
FIG. 7C is a longitudinal-sectional view of a fixing device of an image forming apparatus according to a thirteenth embodiment of the present invention.

The magnetic cores 252, according to the tenth embodiment, are disposed in a pair near the entrance A, thus enabling quick preheating of the entrance A of the printing medium P As shown in FIGS. 7A through 7C, one or more magnetic cores 253, 254 and 255, having a substantially square section may be provided.

Referring to FIG. 7A, a fixing device, according to an eleventh embodiment of the present invention, comprises a magnetic core 253 inclined toward the entrance A and disposed in the first fixing roller 210. A section of the magnetic core 253 is substantially a rectangle.

Referring to FIG. 7B, a fixing device, according to a twelfth embodiment of the present invention, comprises a pair of magnetic cores 254 disposed in the first fixing roller 210 and are inclined toward the entrance A and the exit B, respectively. While the magnetic core 254 has a substantially square section, unlike the magnetic cores 251 of FIG. 6A, the magnetic cores 254 and 251 have the same general effect.

Referring to FIG. 7C, a fixing device, according to a thirteenth embodiment of the present invention, comprises three magnetic cores 255 having a substantially square section. The magnetic cores 255 are disposed inside the first fixing roller 210, and typically are arranged to adjoin one another near the entrance A.

Figure 8:
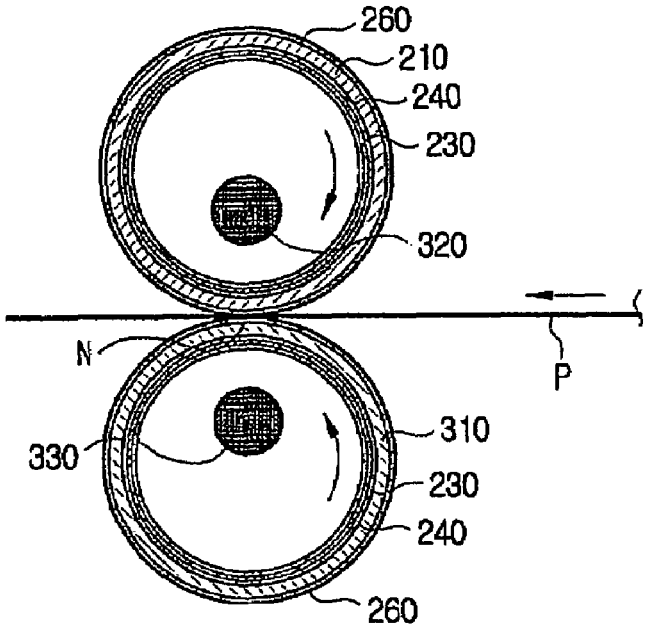
FIG. 8 is a longitudinal-sectional view of a fixing device of an image forming apparatus according to a fourteenth embodiment of the present invention.

Referring to FIG. 8, a fixing device, according to a fourteenth embodiment of the present invention, comprises first and second fixing rollers 210 and 310, and first and second magnetic cores 320 and 330, respectively, mounted in the first and the second fixing rollers 210 and 310. The first and the second fixing rollers 210 and 310 having the same structure as the first fixing roller 210 of FIG. 5A will not be described to avoid repetition. In this case, each of the fixing rollers 210 and 310 may also serve as the heating roller.

The magnetic cores 320 and 330 are disposed in the first and the second fixing rollers 210 and 310, and typically are symmetrically disposed with respect to each other and inclined toward the fixing nip N of the first and the second fixing rollers 210 and 310. The magnetic cores 320 and 330 may have a substantially circular section as in this embodiment, or a substantially square section, as in the aforementioned other embodiments. In addition, although the first and the second fixing rollers 210 and 310 have therein, respectively, one magnetic core 320 and 330, this is only an exemplary structure. As shown in the first through the thirteenth embodiments, a plurality of magnetic cores may be applied to both the first and the second fixing rollers 210 and 310. In this case, the second fixing roller 310 may also serve as the heating roller, and therefore, the elastic member for biasing the second fixing roller 310 toward the first fixing roller 210 may be omitted as shown in FIG. 8.

As described above, the first and the second fixing rollers 210 and 310 quickly reach the fixing temperature by utilizing the magnetic cores 320 and 330. Furthermore, when the second fixing roller 310 includes therein the magnetic core 330 that has a function of the pressing roller as well, efficiency of the fixing operation may be highly improved.

In the above-described embodiments, the first fixing rollers comprise the heating roller to heat the printing medium P by the heaters included therein, and the second fixing rollers comprise the pressing roller to press the printing medium P by the elastic member.

The magnetic cores in the above embodiments are disposed at the inside or the outside of the fixing rollers. However, the magnetic cores may be disposed at both the inside and the outside of the fixing rollers.

As may be appreciated from the above description, the fixing device, according to embodiments of the present invention may be improve thermal conductivity by using the heater, compared to the conventional fixing device that uses a halogen lamp to heat the fixing roller by radiant heat transfer. Accordingly, the warming-up time is eliminated.

In addition, the use of the at least one magnetic core that concentrates the magnetic field on the fixing roller and the leveling of the deflection of the fixing temperature, which is caused by the density difference of the magnetic field between both end portions and the middle portion of the fixing roller, may be counterbalanced. Consequently, the efficiency of the fixing operation is enhanced.

While the invention has been shown and described with reference to certain embodiments thereof, it will be understood by those skilled in the art that various changes in form and details may be made therein without departing from the spirit and scope of the invention as defined by the appended claims and their equivalents.

What is claimed is:

1. A fixing device of an image forming apparatus, comprising:

a fixing roller rotatably mounted on a moving path of a printing medium having a toner image transferred thereon, to fuse the toner image onto the printing medium;

a heater mounted in the fixing roller to generate a magnetic field through an applied voltage to heat the fixing roller; and at least one magnetic core disposed in the vicinity of the fixing roller to concentrate, onto the fixing roller, the magnetic field generated by driving the heater, wherein the at least one magnetic core is exterior to the fixing roller, separated from an outer circumferential surface of the fixing roller by a predetermined distance so that the magnetic core and the fixing roller face each other.

2. The fixing device of claim 1, further comprising a blocking member enclosing the at least one magnetic core and the fixing roller, blocking noise interference.

3. The fixing device of claim 1, wherein the at least one magnetic core is disposed in the fixing roller at a predetermined distance from an inner circumferential surface of the fixing roller.

4. The fixing device of claim 1, wherein the at least one magnetic core is disposed at a center of the fixing roller and extends axially through the fixing roller.

5. The fixing device of claim 1, wherein a pair of magnetic cores are disposed so that magnetic cores of the pair are parallel to each other and to an axis of the fixing roller.

6. The fixing device of claim 1, wherein:

a first magnetic core is exterior to the fixing roller, disposed at a predetermined distance from an outer surface of the fixing roller; and a second magnetic core is disposed in the fixing roller without contacting the fixing roller.

7. The fixing device of claim 1, wherein the at least one magnetic core has a substantially circular cross-section.

8. The fixing device of claim 1, wherein the at least one magnetic core has a substantially polygonal cross-section.

9. The fixing device of claim 1, wherein the heater is mounted in secure contact with an inner circumferential surface of the fixing roller.

10. The fixing device of claim 1, wherein the fixing roller and the heater are rotated together.

11. The fixing device of claim 1, further comprising an insulator between the fixing roller and the heater.

12. The fixing device of claim 1, wherein the heater comprises an induction coil to heat the fixing roller by an induction heat from a magnetic field generated by the applied voltage and a resistance heat from a resistant load of the induction coil.

13. The fixing device of claim 12, wherein the induction coil is formed from at least one material selected from the group consisting of copper, aluminum, nickel, iron, and chrome.

14. A fixing device of an image forming apparatus, comprising:

a first fixing roller rotatably mounted on a moving path of a printing medium which has a toner image transferred thereon;

a second fixing roller rotating in contact with the first fixing roller to fuse the toner image onto the printing medium, wherein the toner image on the printing medium passes through a space between the first and the second fixing rollers;

a heater mounted in at least one of the first and the second fixing rollers to generate a magnetic field through an applied voltage, to heat the fixing roller in which the heater is mounted; and at least one magnetic core disposed in the vicinity of the fixing roller being heated by the heater so that the magnetic field generated by the heater is concentrated upon the fixing roller being heated, wherein the at least one magnetic core is exterior to the fixing roller, separated from an outer circumferential surface of the heated fixing roller by a predetermined distance so that the at least one magnetic core and the heated fixing roller face each other.

15. The fixing device of claim 14, further comprising a blocking member enclosing the at least one magnetic core, and the first and the second fixing rollers, blocking noise interference.

16. The fixing device of claim 14, wherein the at least one magnetic core is disposed in the first fixing roller at a predetermined distance from an inner circumferential surface of the fixing roller.

17. The fixing device of claim 14, wherein the at least one magnetic core is disposed at a center of the fixing roller and extends axially through the fixing roller.

18. The fixing device of claim 14, wherein a first magnetic core is disposed exterior to, at a predetermined distance from, an outer surface the fixing roller having the heater therein; and a second magnetic core is disposed in the fixing roller without contacting the fixing roller.

19. The fixing device of claim 14, wherein, if first and second imaginary lines pass through centers of the first and the second fixing rollers, parallel to a moving direction of the printing medium passing through a space between the first and the second fixing rollers, the at least one magnetic core is disposed between the first and the second imaginary lines.

20. The fixing device of claim 19, wherein a magnetic core is disposed near an entrance of the printing medium passing through a space between the first and the second fixing rollers; and a second magnetic core is disposed near an exit of the printing medium passing through a space between the first and the second fixing rollers.

21. The fixing device of claim 19, wherein a pair of magnetic cores is mounted in the fixing roller having the heater therein.

22. The fixing device of claim 14, wherein the at least one magnetic core is substantially plate shaped.

23. The fixing device of claim 22, wherein the at least one magnetic core is disposed near the entrance of the printing medium passing through a space between the first and the second fixing rollers.

24. The fixing device of claim 14, wherein the heater is mounted in secure contact with an inner circumferential surface of the fixing roller having the heater mounted therein.

25. The fixing device of claim 14, wherein the heater is rotated together with the fixing roller having the heater mounted therein.

26. The fixing device of claim 14, further comprising an insulator between the heater and the fixing roller having the heater mounted therein.

27. The fixing device of claim 14, wherein the first fixing roller serves as a heating roller having the heater mounted therein, and the second fixing roller serves as a pressing roller for pressing the first fixing roller by a predetermined pressure.

28. The fixing device of claim 27, wherein the heater comprises an induction coil to heat the fixing roller by an induction heat from a magnetic field generated by the applied voltage and a resistance heat from a resistant load of the induction coil.

29. The fixing device of claim 28, wherein the induction coil is formed from at least one material selected from the group consisting of copper, aluminum, nickel, iron, chrome, and a combination thereof.

30. The fixing device of claim 14, wherein the at least one magnetic core has a substantially circular cross-section.

31. The fixing device of claim 14, wherein the at least one magnetic core has a substantially polygonal cross-section.

32. A fixing device of an image forming apparatus, comprising:

a magnetic core covered fixing roller to fuse a toner image on a printing medium and to distribute heat across an outer surface of the fixing roller; and a heater mounted in the fixing roller to heat the fixing roller.

33. A fixing device of an image forming apparatus, comprising:

a first magnetic core covered fixing roller and a second fixing roller to fuse a toner image to a printing medium passing therebetween, wherein the first magnetic core covered fixing roller distributes heat across an outer surface of the fixing roller; and a heater mounted in the first magnetic core covered fixing roller.

34. A fixing device of an image forming apparatus, comprising:

a first magnetic core covered fixing roller and a second magnetic core covered fixing roller to fuse a toner image to a printing medium passing therebetween and distribute heat across an outer surface of the fixing roller; and heaters mounted in each of the first and the second magnetic core covered fixing rollers.

* * * * *